US010193260B1

(12) United States Patent
Suzuki et al.

(10) Patent No.: US 10,193,260 B1
(45) Date of Patent: Jan. 29, 2019

(54) MULTI-CONTACT CONNECTOR

(71) Applicant: IRISO ELECTRONICS CO., LTD., Yokohama-shi, Kanagawa (JP)

(72) Inventors: Hitoshi Suzuki, Yokohama (JP); Hiroaki Kobayashi, Yokohama (JP); Yoshiyuki Ogura, Yokohama (JP); Tomomitsu Saito, Yokohama (JP); Daichi Shimba, Yokohama (JP); Koji Kuniyoshi, Yokohama (JP)

(73) Assignee: IRISO ELECTRONICS CO., LTD., Yokohama-Shi, Kanagawa (JP)

( * ) Notice: Subject to any disclaimer, the term of this patent is extended or adjusted under 35 U.S.C. 154(b) by 0 days.

(21) Appl. No.: 16/001,108

(22) Filed: Jun. 6, 2018

(30) Foreign Application Priority Data

Jun. 6, 2017 (JP) ..... 2017-111380

(51) Int. Cl.
*H01R 11/22* (2006.01)
*H01R 13/24* (2006.01)
*H01R 13/10* (2006.01)

(52) U.S. Cl.
CPC ..... *H01R 13/2457* (2013.01); *H01R 13/10* (2013.01)

(58) Field of Classification Search
CPC ... H01R 13/2457; H01R 13/10; H01R 13/112
USPC ..... 439/83, 842, 851
See application file for complete search history.

(56) References Cited

U.S. PATENT DOCUMENTS 8,672,713 B2 * 3/2014 Tajiri ..... H01R 12/585 439/630
9,466,907 B2 * 10/2016 Sakaue ..... H01R 24/60
2005/0020137 A1 1/2005 Tanaka et al.
2012/0252275 A1 10/2012 Tajiri et al.
(Continued)

FOREIGN PATENT DOCUMENTS

JP S48-030755 U 4/1973
JP S58-007477 U 1/1983
JP 07-176339 A 7/1995
(Continued)

OTHER PUBLICATIONS

Extended European Search Report dated Oct. 10, 2018 in corresponding European Patent Application No. 18176107.3.

*Primary Examiner* — Khiem Nguyen
(74) *Attorney, Agent, or Firm* — Buchanan Ingersoll & Rooney PC

(57) ABSTRACT

A multi-contact connector includes terminals, which each include a first contact piece section, which has a first contact section, which achieves pressing contact with a pin terminal in a first direction, and a first elastic arm, which extends in a direction that intersects the first direction and displaceably supports the first contact section, and a second contact piece section, which has a second contact section, which achieves pressing contact with the pin terminal in the first direction, and a second elastic arm, which displaceably supports the second contact section. The second elastic arm extends in the first direction, which intersects the direction in which the first elastic arm extends, and an end portion of the second elastic arm or the end portion in the extending direction, that is, the front end facing the first elastic arm is formed as a spring piece linked to the second contact section.

8 Claims, 15 Drawing Sheets

(56) References Cited

U.S. PATENT DOCUMENTS

2015/0340788 A1 11/2015 Sakaue et al.

FOREIGN PATENT DOCUMENTS

| | | | |
|---|---|---|---|
| JP | 2004-152623 | A | 5/2004 |
| JP | 2012-221592 | A | 11/2012 |
| JP | 2015-005504 | A | 1/2015 |
| JP | 2016-173897 | A | 9/2016 |

* cited by examiner

MULTI-CONTACT CONNECTOR

BACKGROUND OF THE INVENTION

Field of the Invention

The present invention relates to a multi-contact connector having a plurality of contacts that come into contact with a connection target object.

Description of the Related Art

As a connector that achieves electrically continuous connection between a circuit in a substrate and a connection target object with high connection reliability, there is a known multi-contact connector having a plurality of contacts that achieve electrically continuous connection with a connection target object (Japanese Patent Laid-Open No. 2012-221592 and FIG. 9 of Japanese Patent Laid-Open No. 2015-5504). In the case of a multi-contact connector, even if one of the contacts that are in contact with the connection target object fails to achieve electrical continuity, the other contact still achieves electrically continuous contact, whereby the electrically continuous connection that the connector should achieve can maintained. In particular, in a case where foreign matter, such as substrate residues and dust, adheres to a counterpart terminal, an FPC, or any other flat conductor, which is the connection target object, the foreign matter sandwiched between any of the contacts and the connection target object is likely to cause electrical continuity failure, and a multi-contact connector having a plurality of contacts is therefore believed to be useful.

Considering the arrangement of the plurality of contacts of each of the terminals of a multi-contact connector, the plurality of contacts are so disposed as to be positionally shifted along the insertion direction of the connection target object. For example, in the multi-contact connector described in Japanese Patent Laid-Open No. 2015-5504, each terminal includes a base section fixed to a housing and a front terminal and a rear terminal that extend from the base section. The front terminal is formed of two front spring sections that extend from the base section in parallel to each other in the form of a cantilever and a front contact that links the front ends of the two front spring sections to each other and achieves electrically continuous contact with a connection target object. On the other hand, the rear terminal is formed of one rear spring section that is disposed between the two front spring sections and extends from the base section in the form of a cantilever and a rear contact provided at the front end of the rear spring section. Many multi-contact connectors employ the terminal structure described above (see FIG. 1 of Japanese Utility Model Laid-Open No. 48-30755, FIGS. 1 to 3 of Japanese Patent Laid-Open No. 2004-152623, FIGS. 3 and 4 of Japanese Utility Model Laid-Open No. 58-7477).

The multi-contact connectors of related art described above, however, have a problem of an increase in the length of each of the terminals and hence an increase in the size of the multi-contact connector itself. That is, the front terminal and the rear terminal, which extend from the base section, need to be so configured that the front spring sections and the rear spring section are each long enough for elasticity as a spring. Further, since the front contact and the rear contact need to be provided at the front ends of the front spring sections and the rear spring section, the length of the terminal undesirably increases along the insertion direction of the connection target object.

The present invention has been made based on the related art described above. An object of the present invention is to provide a multi-contact connector that allows the terminals to be shortened. Another object of the present invention is to reduce the size of the multi-contact connector based on the shortened terminals.

SUMMARY OF THE INVENTION

To achieve the objects described above, the present invention has the following features:

That is, the present invention relates to a multi-contact connector including terminals each including a first contact piece section having a first contact section that achieves pressing contact with a connection target object in a first direction and a first elastic arm that extends in a direction that intersects the first direction and displaceably supports the first contact section, and a second contact piece section having a second contact section that achieves pressing contact with the connection target object in the first direction and a second elastic arm that displaceably supports the second contact section, and the second elastic arm extends in the first direction toward the first elastic arm and has a front end portion that faces the first elastic arm and is formed as a spring piece linked to the second contact section.

According to the present invention, the second elastic arm extends in the first direction, which intersects the direction in which the first elastic arm extends, and an end portion of the second elastic arm or the end portion in the extending direction, that is, the front end facing the first elastic arm is formed as a spring piece linked to the second contact section. It is therefore unnecessary to employ the terminal structure of related art in which the first elastic arm and the second elastic arm extend from the same portion of the terminal in parallel to each other, and the novel terminal structure in which the second elastic arm extends toward the first elastic arm allows reduction in the total length of the terminal as compared with the total length of each terminal of the multi-contact connector of related art, whereby the multi-contact connector, which includes the terminals, can be so formed as to be compact.

The second contact section can be configured to face the first elastic arm.

According to the present invention, since the second contact section faces the first elastic arm, the size of the terminal structure can be reduced. In a case where the second contact section is a flat-plate-shaped contact piece, the second contact section can be so disposed that the plate surface of the second contact section and the plate surface of the first elastic arm face each other. As a result, since the plate surfaces face each other and extend in parallel to each other, the size of the terminal structure can be reduced.

The terminals can each be configured to have a support piece to which the second elastic arm is linked.

According to the present invention, since the support piece to which the second elastic arm is linked is provided, the second elastic arm can be configured as a cantilever-shaped spring piece supported by the support piece and extending in the first direction.

The support piece can be so formed as to extend from a portion linked to the second elastic arm to a position facing the second contact section.

According to the present invention, the support piece, which is so shaped as to face the second contact section, can accept the connection target object that receives the pressing contact achieved by the second contact section. Therefore, as compared with a case where the connection target object is accepted by a resin housing of a multi-contact connector, the tolerance of the distance between the second contact section and a connection target object receiving surface can be managed based only on the tolerance of the terminal, whereby the connection target object can be appropriately held irrespective of the precision of molding of the resin housing and the precision of assembly thereof. Further, the support piece can be shortened as compared with a case that will be described later where the support piece is so formed as to extend to the position facing both the first contact section and the second contact section, and the size of the entire terminal can also be reduced.

The support piece can be so formed as to extend from a portion linked to the second elastic arm to a position facing the first contact section and the second contact section.

According to the present invention, the support piece, which is so shaped as to face the first contact section and the second contact section, can accept the connection target object that receives the pressing contact achieved by the first contact section and the second contact section. Therefore, as compared with the case where the connection target object is accepted by a resin housing of a multi-contact connector, the tolerance of the distances from the first and second contact sections to the connection target object receiving surface can be managed based only on the tolerance of the terminal, whereby the connection target object can be appropriately held irrespective of the precision of molding of the resin housing and the precision of assembly thereof.

The second elastic arm can be so shaped as to link opposing plate edges of the second contact section and the support piece.

According to the present invention, the second contact section achieves pressing contact with the connection target object in the first direction, in which the first contact section achieves pressing contact with the connection target object, but the second elastic arm, which supports the second contact section, extends from one of the plate edges of the support piece, which faces the first contact piece section, whereby the size of the second contact piece section can be reduced. Therefore, the size of the contact section, which has a terminal structure having the two contact piece sections, can be reduced, and the size of the multi-contact connector can also be reduced.

The terminals can each be configured to have a fixed base section that supports the first contact piece section in a form of a cantilever and a linkage section that extends in the first direction and links the fixed base section to the support piece.

According to the present invention, since the terminals each have the fixed base section, which supports the first contact piece section in the form of a cantilever, and the linkage section, which extends in the first direction and links the fixed base section to the support piece, the fixed base section and the support piece can be integrated with each other via the linkage section.

The first contact piece section can be configured to have a clearance recess section that avoids contact with the second contact section displaced toward the first contact piece section when the second contact section receives the pressing contact achieved by the connection target object.

According to the present invention, the first contact piece section has the clearance recess section. The second contact section, when it is displaced by the pressing contact produced by the connection target object, therefore does not come into contact with first contact piece section. The first contact piece section and the second contact section can therefore be so disposed as to approach each other, as compared with a case where the first contact piece section is provided with no clearance recess section, whereby the entire size of the contact section can be reduced, and the size of the multi-contact connector can also be reduced.

According to the present invention, the terminal structure in which the first contact section and the second contact section, which achieve electrically continuous contact with the connection target object, are provided and the second elastic arm extends toward the first elastic arm allows the total length of each of the terminals to be shortened, whereby a compact multi-contact connector having high connection reliability can be provided.

DETAILED DESCRIPTION OF THE PREFERRED EMBODIMENTS

Embodiments of a multi-contact connector according to the present invention will be described below with reference to the drawings. In the scope of the present specification and claims, the width direction or the rightward/leftward direction of the multi-contact connector is a direction X, the depth direction or the frontward/rearward direction thereof is a direction Y, and the height direction or the upward/downward direction thereof is a direction Z for ease of description, but the definition of the directions is not intended to limit a method for mounting the multi-contact connector or a method for using the multi-contact connector.

First Embodiment [FIGS. 1 to 10]

Figure 9:
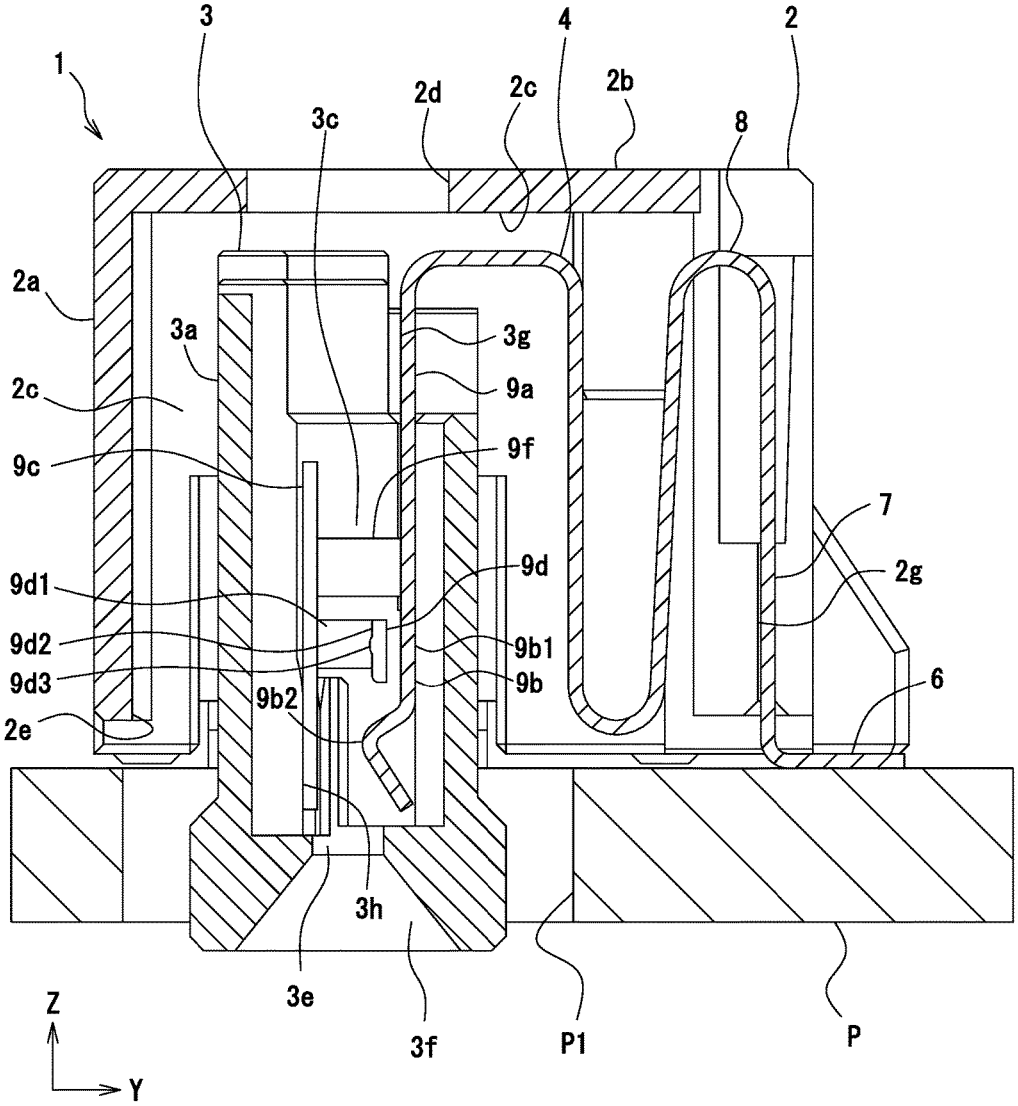
FIG. 9 is a cross-sectional view taken along the line IX-IX in FIG. 2.
Figure 10:
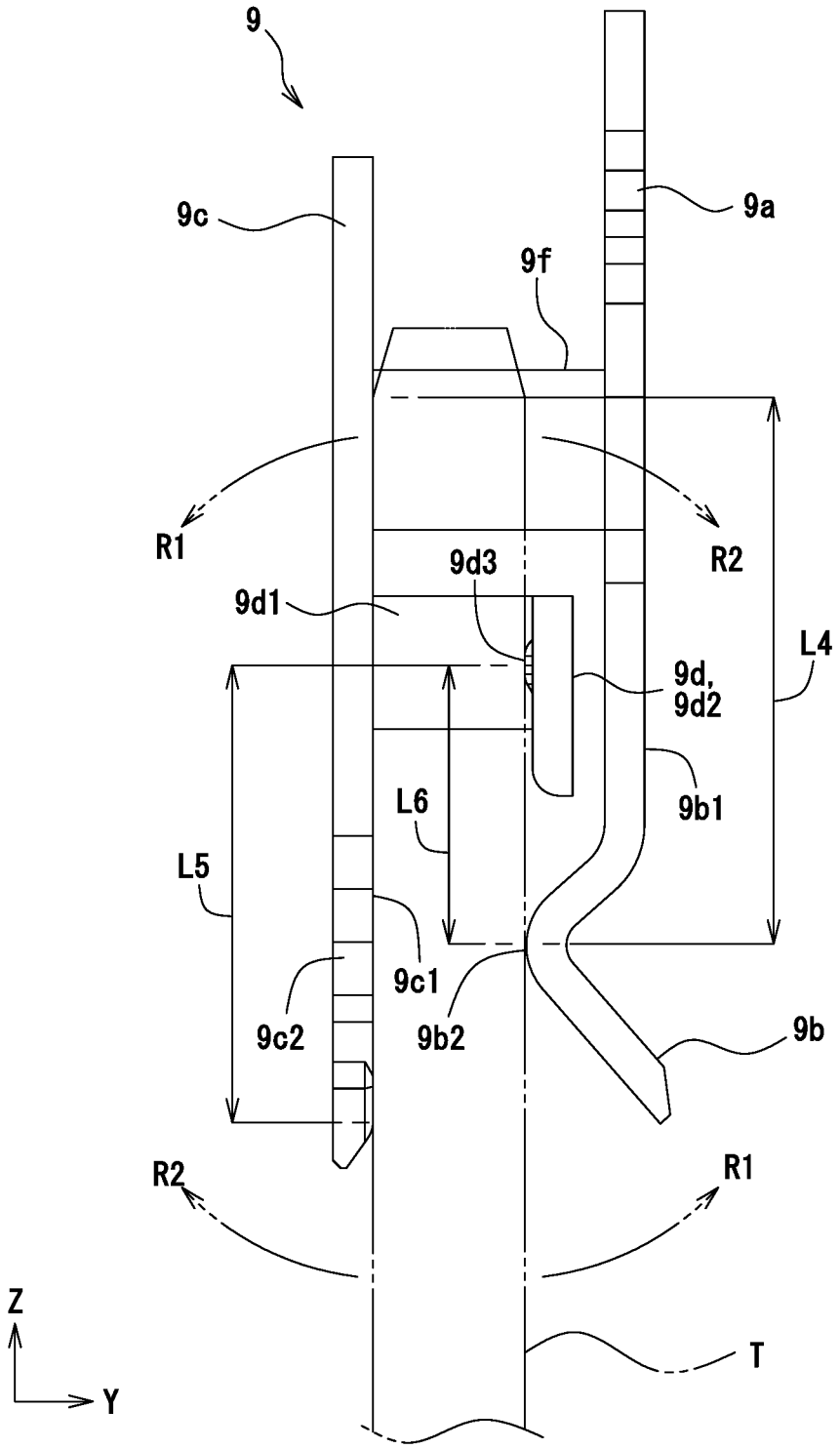
FIG. 10 describes the action of the terminal shown in FIG. 6.

A multi-contact connector 1 includes a fixed housing 2 as a "first housing," a movable housing 3 as a "second housing," a plurality of terminals 4, and a plurality of fixtures 5, which fix the fixed housing 2 to a substrate P. The multi-contact connector 1 is configured as a movable connector in which the plurality of terminals 4 support the movable housing 3 in such a way that the movable housing 3 is displaceable relative to the fixed housing 2. The multi-contact connector 1 is configured as a bottom-entry connector which is mounted on one surface of the substrate P and into which pin terminals T as the "connection target object" are inserted via the other surface of the substrate P for electrically continuous connection (FIGS. 9 and 10).

[Fixed Housing 2]

Figure 1:
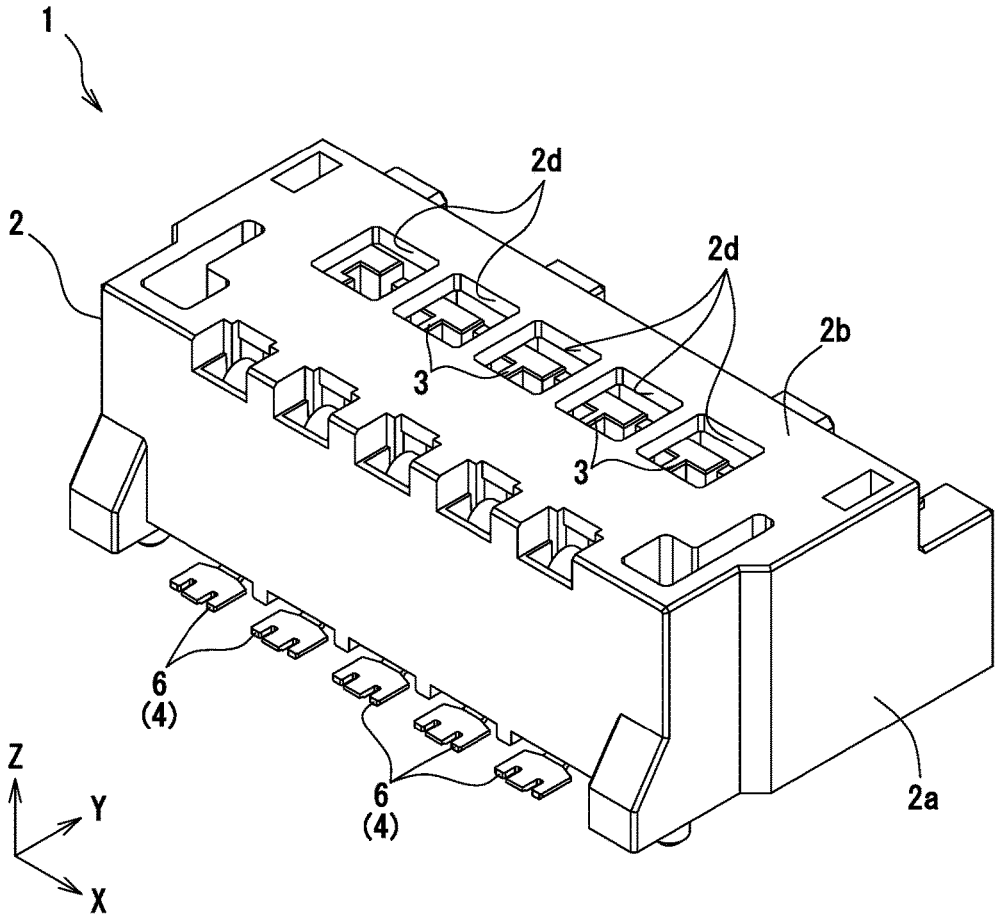
FIG. 1 is an exterior perspective view including the front surface, the right side surface, and the plan surface of a multi-contact connector according to a first embodiment.
Figure 2:
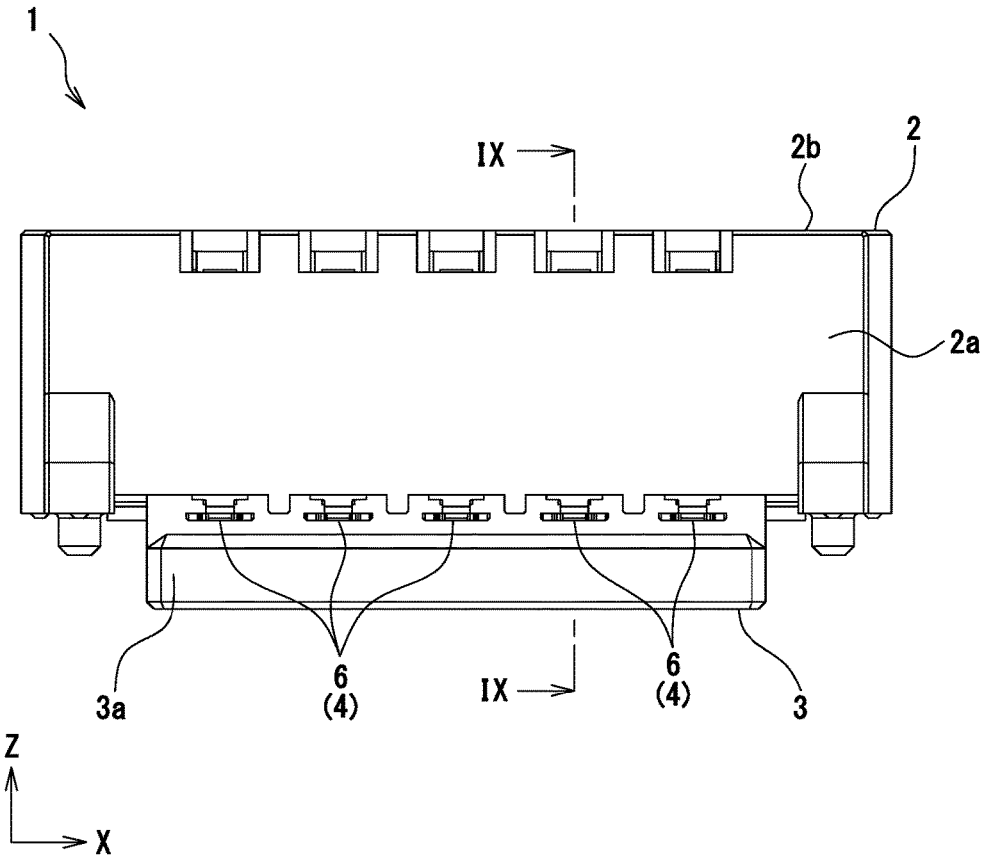
FIG. 2 is a front view of the multi-contact connector shown in FIG. 1.
Figure 3:
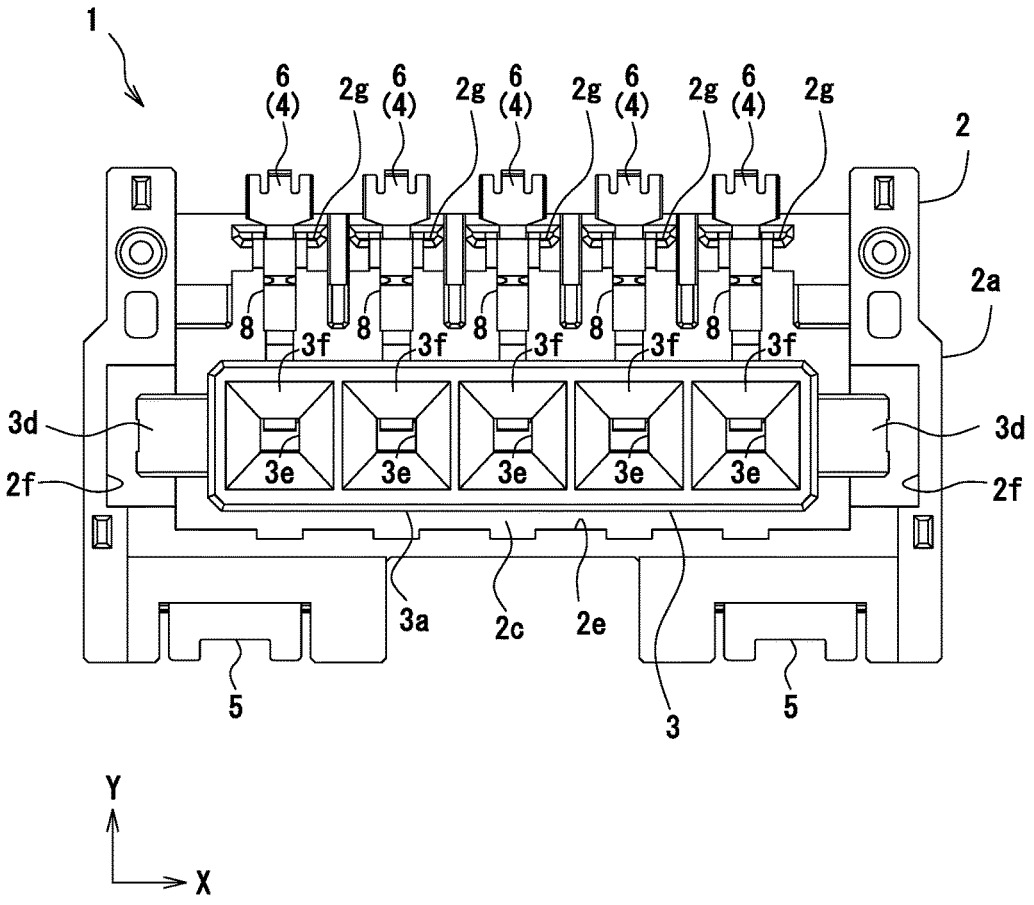
FIG. 3 is a bottom view of the multi-contact connector shown in FIG. 1.
Figure 4:
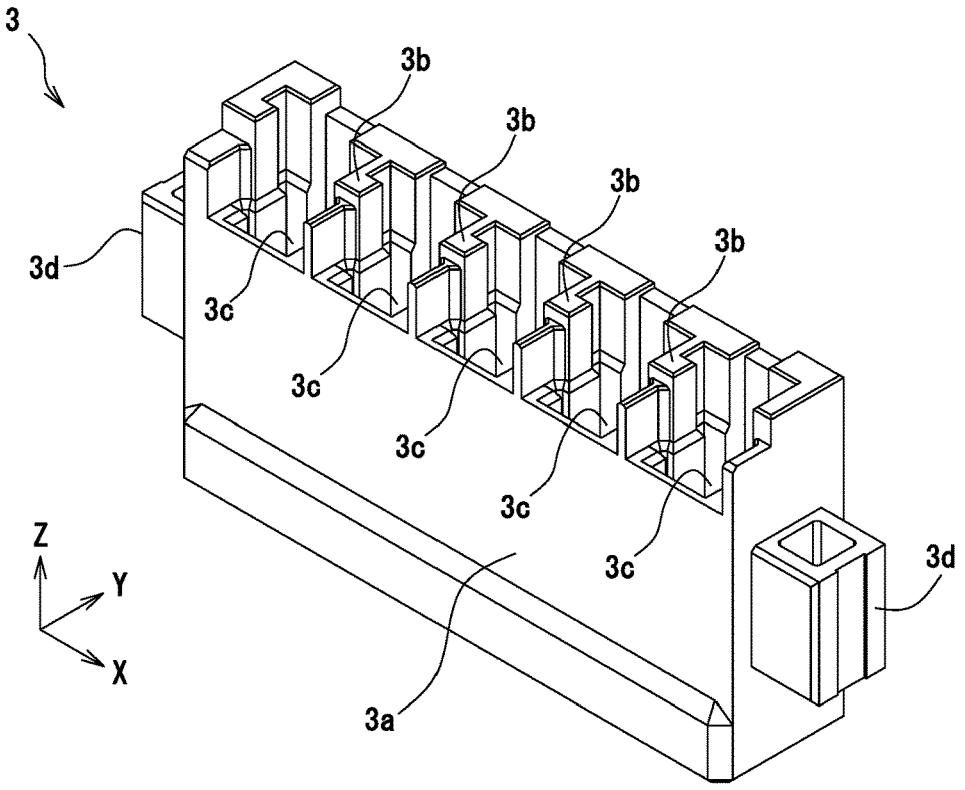
FIG. 4 is an exterior perspective view including the front surface, the right side surface, and the plan surface of a movable housing provided in the multi-contact connector shown in FIG. 1.
Figure 5:
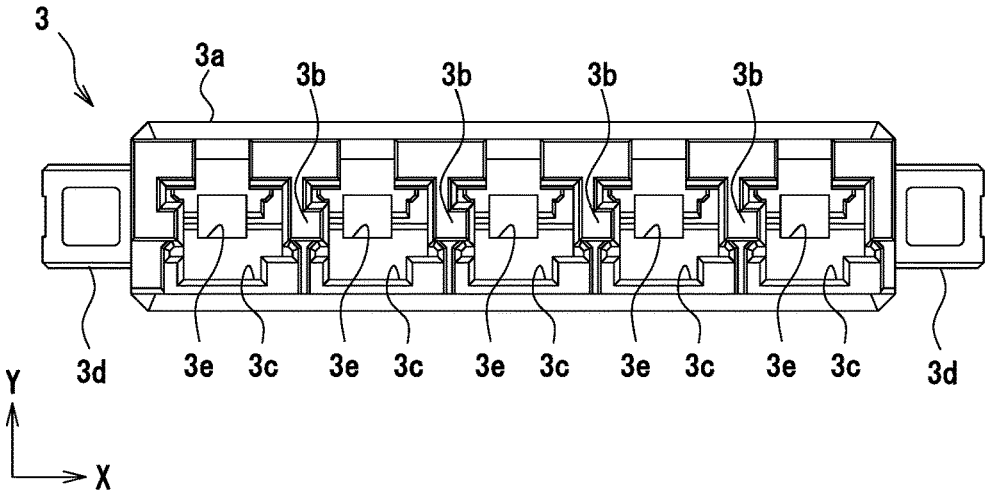
FIG. 5 is a plan view of the movable housing shown in FIG. 3.

The fixed housing 2 is formed of a resin molded body and has an outer circumferential wall 2*a* and a top wall 2*b*. The outer circumferential wall 2*a* is formed in a rectangular tubular shape, and an accommodation chamber 2*c*, which accommodates the movable housing 3, is formed inside the outer circumferential wall 2*a* and the top wall 2*b* (FIGS. 3 and 9). The movable housing 3 is so held by the plurality of terminals 4 as to be displaceable in three-dimensional directions in the in-chamber space of the accommodation chamber 2*c*. The fixtures 5 described above are press-fitted and fixed to the rear surface of the outer circumferential wall 2*a* of the fixed housing 2 and in opposite positions in the width direction X (FIG. 3). A plurality of top openings 2*d*, which allow visual recognition of the state of connection between the pin terminals T and the terminals 4, are formed in the top wall 2*b* of the fixed housing 2 (FIGS. 1 and 9). In the present embodiment, five top openings 2*d* are arranged in a single row along the width direction X. The top openings 2*d* also function as heat dissipating windows for dissipating heat generated in the pin terminals T and the terminals 4 when current flows therethrough out of the fixed housing 2. A bottom opening 2*e* is formed in the bottom surface of the fixed housing 2, and the movable housing 3 is inserted through the bottom opening 2*e* into the accommodation chamber 2*c*.

[Movable Housing 3]

The movable housing 3 is formed of a resin molded body so sized in the width direction X and the depth direction Y as to be accommodated in the accommodation chamber 2*c* of the fixed housing 2 and has an outer circumferential wall 3*a* and a plurality of partition walls 3*b*, which divide the interior of the outer circumferential wall 3*a* into a plurality of spaces. The outer circumferential wall 3*a* is formed in a rectangular tubular shape, and inner spaces surrounded by the outer circumferential wall 3*a* and the partition walls 3*b* are configured as a plurality of connection chambers 3*c*, where the terminals 4 achieve electrically continuous connection with the pin terminals T. In the present embodiment, five connection chambers 3*c* are arranged in a single row along the width direction X. Contact sections 9 of the terminals 4, which will be described later, are fixed in the connection chambers 3*c*. Displacement restricting protrusions 3*d* are so formed as to protrude from the opposite side surface, in the width direction X, of the outer circumferential wall 3*a*. The displacement restricting protrusions 3*d* are so disposed as to protrude into displacement restricting recesses 2*f*, which are formed on both sides, in the width direction X, of the accommodation chamber 2*c* of the fixed housing 2 described above (FIG. 3). The movable housing 3 is displaceable until the displacement restricting protrusions 3*d* abut against the displacement restricting recesses 2*f* in the rightward/leftward direction X, the frontward/rearward direction Y, and the height direction Z (only upward). The downward displacement in the height direction Z is restricted when the displacement restricting protrusions 3*d* abut against the substrate P. A lower end portion of the movable housing 3 has been inserted through a through hole P1 of the substrate P and protrudes beyond the rear surface of the substrate P (FIG. 9). Insertion ports 3*e*, through which the pin terminals T are inserted, are formed in the bottom surface of the movable housing 3. The insertion ports 3*e* each have a funnel-shaped guiding inclining surface 3*f*, and the pin terminals T are guided along the guiding inclining surfaces 3*f* and inserted via the insertion ports 3*e* into connection chambers 3*c*.

[Terminals 4]

The terminals 4 each include a substrate fixing section 6, a fixed housing fixing section 7, which is press-fitted and fixed to the fixed housing 2, a movable section 8, which supports the movable housing 3 in such a way that the movable housing 3 is displaceable relative to the fixed housing 2, and a contact section 9, which is accommodated in the corresponding connection chamber 3*c* of the movable housing 3 and achieves electrically continuous connection with the corresponding pin terminal T. The functional portions and the shape of each of the terminals 4 are achieved and formed by bending a punched electrically conductive metal piece and integrated with one another. That is, the terminals 4 are each formed as a single part.

The substrate connecting section 6 protrudes frontward beyond the front surface of the fixed housing 2 and is soldered to the substrate P. The fixed housing 2 is fixed by the substrate connecting sections 6 on the front side of the fixed housing 2 and fixed by the fixtures 5 in a soldering process on the rear side of the fixed housing 2, whereby the fixed housing 2 can reliably accept the force produced when the plurality of pin terminals T are inserted via the rear surface of the substrate P.

Figure 6:
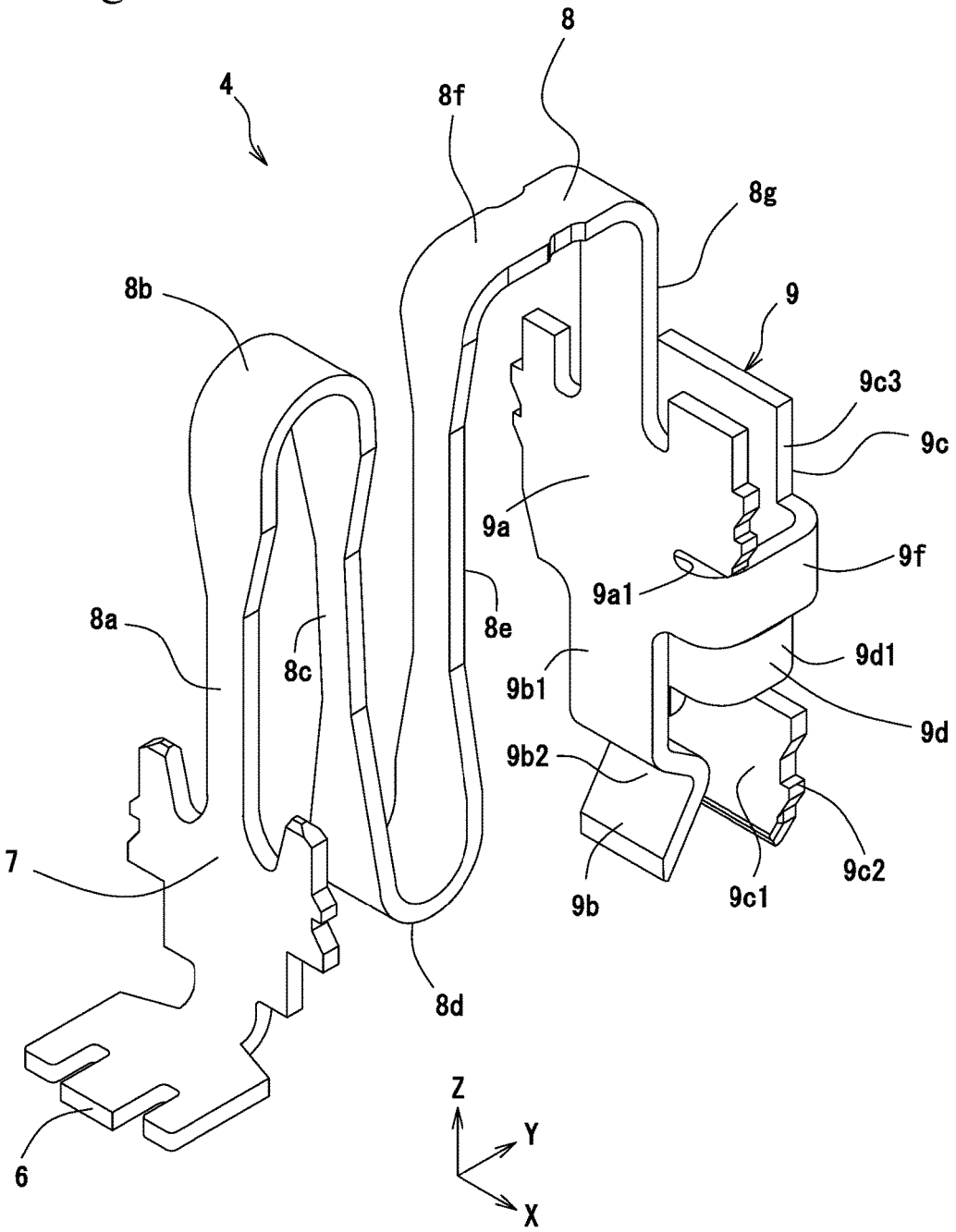
FIG. 6 is an exterior perspective view including the front surface, the right side surface, and the plan surface of a terminal provided in the multi-contact connector shown in FIG. 1.
Figure 7:
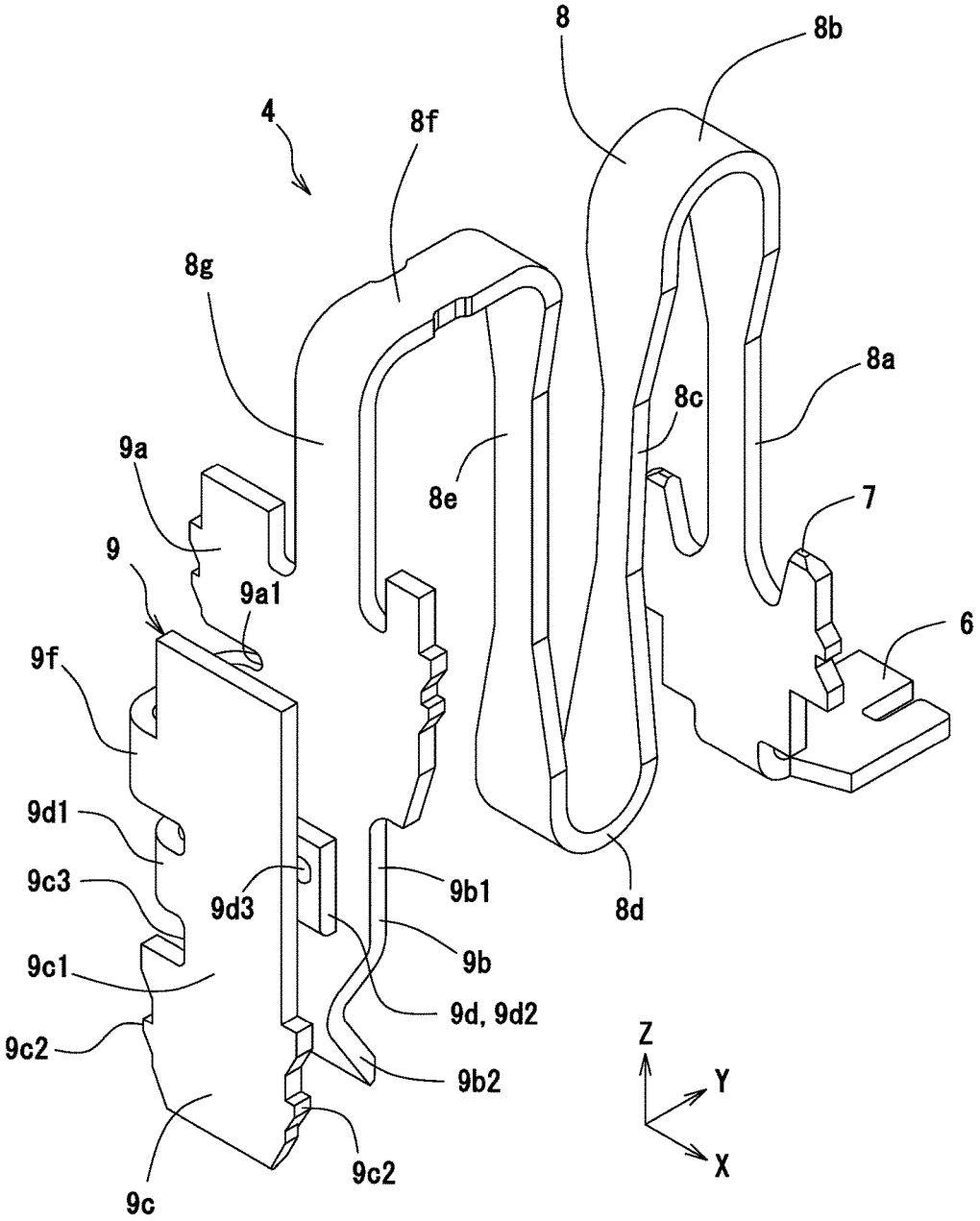
FIG. 7 is an exterior perspective view including the rear surface, the left side surface, and the plan surface of the terminal shown in FIG. 6.
Figure 8:
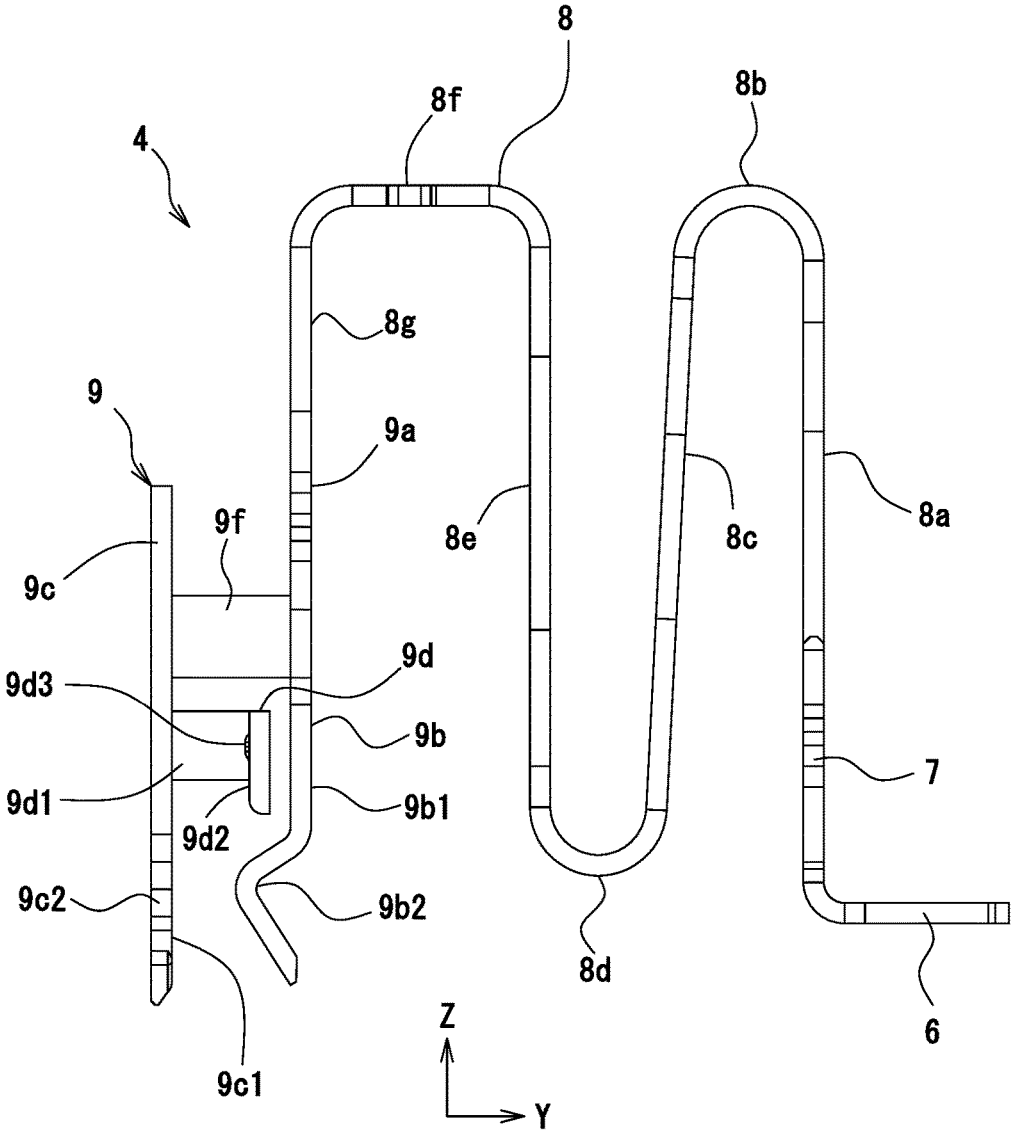
FIG. 8 is a left side view of the terminal shown in FIG. 6.

The fixed housing fixing section 7 is press-fitted and fixed to the corresponding one of terminal fixing grooves 2*g*, which are provided in the accommodation chamber 2*c* of the fixed housing 2 (FIGS. 3 and 9). The movable section 8 has a first extending section 8*a*, which extends upward from the fixed housing fixing section 7, a first bent section 8*b*, which is folded back at the upper end of the first extending section 8*a*, a second extending section 8*c*, which extends from the first bent section 8*b* in parallel to the first extending section 8*a*, a second bent section 8*d*, which is folded back at the lower end of the second extending section 8*c*, a third extending section 8*e*, which extends from the second bent section 8*d* in parallel to the second extending section 8*c*, a third bent section 8*f*, which is folded back at the upper end of the third extending section 8*e*, and a fourth extending section 8*g*, which is linked to a fixed base section 9*a*, which will be described later, as shown in FIGS. 6 to 8. The first extending section 8*a*, the second extending section 8*c*, and the third extending section 8*e* are so each formed that the plate width thereof along the direction X gradually decreases with distance from the side where the extending section is linked to the first bent section 8*b*, the second bent section 8*d*, or the third bent section 8*f*, whereby the extending section can achieve softness as a spring. Further, the movable section 8 has a long spring length because three longitudinal spring pieces (first extending section 8*a*, second extending section 8*c*, and third extending section 8*e*) that extend in the upward/downward direction (direction Z) are arranged in parallel to one another. The third extending section 8*e* may be omitted if the movable section 8 only needs to be displaceable in the frontward/rearward direction Y. However, the three longitudinal spring pieces disposed in parallel to one another as described above not only allow the movable housing 3, which is particularly displaced in the frontward/rearward direction Y, to be so elastically supported that the movable housing 3 can be flexibly displaced but increase durability as a spring.

The contact section 9 has a fixed base section 9*a*, which is linked to the fourth extending section 8*g* of the movable section 8 and fixed to the movable housing 3, a first contact piece section 9*b*, which extends from the fixed base section 9*a* in the form of a cantilever, a contact receiving section 9*c*, which faces the first contact piece section 9*b* as a "support piece", a second contact piece section 9*d*, which extends from the contact receiving section 9*c* in the form of a cantilever, and a linkage section 9*f*, which links the fixed base section 9*a* to the contact receiving section 9*c*, as shown in FIGS. 6 to 8.

The fixed base section 9*a* is press-fitted fixed to the corresponding one of first terminal fixing grooves 3*g*, which are provided in the movable housing 3, as shown in FIG. 9.

The first contact piece section 9*b* has a first elastic arm 9*b*1, which extends from the fixed base section 9*a*, and a first contact section 9*b*2, which is displaceably supported by the first elastic arm 9*b*1 and achieves pressing contact with the corresponding pin terminal T, which is the connection target object, in a "first direction," that is, from the front side toward the rear side in the frontward/rearward direction Y. The first contact section 9*b*2 is so formed as to protrude in a convexly bent shape toward the contact receiving section 9*c*.

The contact receiving section 9*c*, which forms the "support piece" of the present invention, is formed, as a whole, as a flat-plate-shaped metal piece, and a surface of the contact receiving section 9*c* facing the first contact piece section 9*b* is formed as a flat contact surface section 9*c*1, which extends along the insertion direction of the pin terminals T (direction Z). The contact surface section 9*c*1, which is a portion that comes into contact with the corresponding pin terminal T, is so formed as to be longer than at least the inter-contact distance between the first contact section 9*b*2 and a second contact section 9*d*2 (contact 9*d*3). The contact receiving section 9*c*, which is so shaped as to face both the first contact section 9*b*2 and the second contact section 9*d*2, can accept the pin terminal T that receives pressing contact achieved by both the first contact section 9*b*2 and the second contact section 9*d*2. Therefore, as compared with a case where the pin terminal T is accepted, for example, by the resin wall of the connection chamber 3*c* of the movable housing 3, the tolerance of the distances from the first contact section 9*b*2 and the second contact section 9*d*2 to the contact receiving section 9*c*, which serves as the surface that receives the pin terminal T, can be managed based only on the tolerance of the terminal 4, whereby the pin terminal T can be appropriately held at predetermined contact pressure irrespective of the precision of molding of the movable housing 3, which is formed of a molded body, and the precision of assembly of the terminal 4 to the movable housing 3. An end portion of the contact receiving section 9*c* facing the first contact section 9*b*2 has fixing sections 9*c*2, which are press-fitted and fixed to the corresponding one of second terminal fixing grooves 3*h* of the movable housing 3, as shown in FIG. 9. The contact receiving section 9*c* itself is therefore press-fitted and fixed to the movable housing 3 independently of the other sections of the contact section 9. The contact surface section 9*c*1 is so disposed as to be exposed to the corresponding connection chamber 3*c* of the movable housing 3 except the fixing sections 9*c*2, which are press-fitted and fixed to the second terminal fixing groove 3*h*. The reason for this is that the contact surface section 9*c*1 receives sliding contact provided by the pin terminal T inserted into the connection chamber 3*c* and achieves electrically continuous connection with the pin terminal T in the fitting state. A surface of the contact receiving section 9*c* which is opposite the contact surface section 9*c*1 is in contact with the resin wall of the movable housing 3, and the pressing force received from the pin terminal T is accepted by the resin wall via the contact receiving section 9*c*.

The second contact piece section 9*d* has a second elastic arm 9*d*1 and the second contact section 9*d*2, as shown in FIGS. 8 and 10. The second elastic arm 9*d*1 has a base end linked to one of plate edges 9*c*3 (right plate edge) of the contact receiving section 9*c* (FIGS. 6 and 7), bends from the plate edge 9*c*3, and extends toward the first contact piece section 9*b*. More specifically, the front end of the second elastic arm 9*d*1 extends to a position above the first contact section 9*b*2, which has a convexly bent shape, and adjacent to the first elastic arm 9*b*1, as shown in FIG. 8, and the front end is linked to the second contact section 9*d*2, which is formed of a plate piece parallel to the plate surface of the first elastic arm 9*b*1, via a bent portion. Therefore, the second contact section 9*d*2, seen from the insertion direction Z of the pin terminals T, is so disposed as to be hidden behind the first contact section 9*b*2, which has a convexly bent shape. The second contact section 9*d*2 is formed in a plate-like shape, and a surface of the second contact section 9*d*2 facing the contact receiving section 9*c* has the contact 9*d*3, which achieves pressing contact with the pin terminal T.

The linkage section 9*f* has one end linked to one of plate edges 9*a*1 (right plate edge) of the fixed base section 9*a* (FIGS. 6 and 7) and the other end formed as a spring piece linked to the right plate edge 9*c*3 of the contact receiving section 9*c*. The linkage section 9*f* and the second elastic arm 9*d*1 are therefore disposed side by side in the direction Z. The contact receiving section 9*c* is fixed to the movable housing 3 via the fixing sections 9*c*2 on the front end side (lower end side), and the contact receiving section 9*c* is further fixed to the movable housing 3 via the linkage section 9*f* and the fixed base section 9*a* on the opposite side (upper end side) because the other end of the linkage section 9*f* is linked to the contact receiving section 9*c*. Therefore, the contact receiving section 9*c* is reliably fixed to the movable housing 3 and can accept the contact provided by the pin terminal T when the contact receiving section 9*c* is in contact with the pin terminal T along the length thereof.

[Advantageous Effects of Multi-Contact Connector 1]

Advantageous effects of the thus configured multi-contact connector 1 will next be described.

The multi-contact connector 1 is so configured that the movable housing 3 is so supported by the movable sections 8 of the terminals 4 as to be displaceable relative to the fixed housing 2 in the three-dimensional directions (direction X, direction Y, direction Z, and combination thereof). Therefore, in the fitting connection of the pin terminals T, a shift in the insertion position of the pin terminals T can be absorbed by displacement of the movable housing 3 for adequate fitting connection. In the fitting connection state in which the pin terminals T are located in the proper contact position and achieve electrically continuous connection, when the pin terminals T or the substrate P is displaced due to vibration or impact, the vibration or any other external factor can be absorbed by displacement of the movable housing 3. Further, in the fitting connection state, both the first contact section 9*b*2 and the second contact section 9*d*2 achieve electrically continuous contact with a pin terminal T while pressing the pin terminal T. Therefore, even if one of the contact sections fails to achieve the electrically continuous contact, the other contact section maintains the electrically continuous contact, whereby highly reliable electrically continuous connection can be achieved.

In addition to the basic advantageous effect described above, the multi-contact connector 1 has the following features: The second elastic arm 9*d*1 extends in the first direction (direction Y), which intersects the direction in which the first elastic arm 9*b*1 extends (direction Z), and an end portion in the extending direction of the second elastic arm 9*d*1, that is, the front end facing the first elastic arm 9*b*1 is formed as a spring piece linked to the second contact section 9*d*2. It is therefore unnecessary to employ the terminal structure of related art in which the first elastic arm 9*b*1 and the second elastic arm 9*d*1 extend from the same portion of the terminal 4 in parallel to each other, and the novel terminal structure in which the second elastic arm 9*d*1 extends toward the first elastic arm 9*b*1 allows reduction in the total length of the contact section 9 of the terminal 4 in the insertion direction of the pin terminals T (direction Z) as compared with the total length of the contact section of each terminal of the multi-contact connector of related art, whereby the multi-contact connector 1, which includes the terminals 4, can be so formed as to be compact.

A pin terminal T is so pressed by the first contact section 9*b*2 and the second contact section 9*d*2 as to come into contact therewith, and the pin terminal T comes into contact with the flat contact surface section 9*c*1 of the contact receiving section 9*c* in the pressing contact direction (direction Y). The contact surface section 9*c*1 has a flat surface shape that comes into contact with a pin terminal T along the length of the pin terminal T in accordance with the length of the inserted pin terminal T, resulting in no unstable electrically continuous contact with the pin terminal T. The multi-contact connector 1 can therefore more reliably suppress pivotal motion (inclination) of the pin terminal T at the first contact section 9*b*2 and the second contact section 9*d*2 (contact protrusion 9*d*3), which each serve as the center of the pivotal motion.

In the multi-contact connector 1, the pin terminal T, when it pivots in the counterclockwise direction R1, comes into contact with the first contact section 9*b*2 on the side close to the insertion port 3*e* of the connection chamber 3*c*, as shown in FIG. 10. On the other hand, on the far side in the connection chamber 3*c*, the insertion-side end portion of the pin terminal T comes into contact with the contact surface section 9*c*1. A long inter-contact distance L4 can thus be provided and reduce the effect of the pivotal motion of the pin terminal T in the counterclockwise direction R1, whereby even slight pivotal motion can be reliably handled. The pin terminal T tries to pivot around the point where the pin terminal T is in contact with the non-displacing contact surface section 9*c*1, but the pivotal motion is not allowed not only by the first contact piece section 9*b* but the second contact piece section 9*d*, which is located between the pin terminal T and the first contact piece section 9*b*. The two contact piece sections, the first contact piece section 9*b* and the second contact piece section 9*d*, can thus more reliably suppress the pivotal motion of the pin terminal T in the counterclockwise direction R1, whereby occurrence of plated film separation due to the minute sliding contact and other undesirably phenomena can be avoided.

Similarly, the pin terminal T, when it pivots in the clockwise direction R2, comes into contact with the second contact section 9*d*2 (contact protrusion 9*d*3) on the far side in the connection chamber 3*c*. On the other hand, on the side close to the insertion port 3*e* of the connection chamber 3*c*, the lower end of the flat contact surface section 9*c*1 comes into contact with the pin terminal T. A long inter-contact distance L5 can thus be provided and reduce the effect of the pivotal motion of the pin terminal T in the clockwise direction R2, whereby even slight pivotal motion can be reliably handled. The pin terminal T tries to pivot around the point where the pin terminal T is in contact with the lower end of the non-displacing contact surface section 9*c*1, but the pivotal motion is not allowed not only by the second contact piece section 9*d* but the first contact piece section 9*b*, which is located between the pin terminal T and the second contact piece section 9*d*. The two contact piece sections, the first contact piece section 9*b* and the second contact piece section 9*d*, can thus more reliably suppress the pivotal motion of the pin terminal T in the clockwise direction R2, whereby occurrence of plated film separation due to the minute sliding contact and other undesirably phenomena can be avoided.

In the multi-contact connector 1, the long inter-contact distances L4 and L5 reliably suppress the pivotal motion of the pin terminal T at the first contact section 9*b*2 and the second contact section 9*d*2 (contact protrusion 9*d*3), which each serves as the center of the pivotal motion, but a short inter-contact distance L6 between the first contact section 9*b*2 and the second contact section 9*d*2 (contact protrusion 9*d*3) is achieved, as shown in FIG. 10, whereby an increase in the size of the contact section 9 is suppressed. That is, the contact surface section 9*c*1 is formed as a flat surface extending from a point close to the insertion port 3*e* to a point beyond the first contact section 9*b*2 and the second contact section 9*d*2 (contact protrusion 9*d*3) in the insertion direction of the pin terminals T (direction Z). The position where the pin terminal T comes into contact with the contact surface section 9*c*1 on the far side in the insertion direction when the pin terminal T pivots in the counterclockwise direction R1 can therefore be a farther position in the connection chamber 3*c* beyond the second contact section 9*d*2 (contact protrusion 9*d*3). Similarly, the position where the pin terminal T comes into contact with the contact surface section 9*c*1 on the side close to the insertion port 3*e* when the pin terminal T pivots in the clockwise direction R2 can be a position shifted toward the insertion port 3*e* beyond the first contact section 9*b*2. The pivotal motion of the pin terminal T can therefore be more reliably suppressed with a short inter-contact distance L6 and hence no increase in the size of the contact section 9.

The contact receiving section 9*c* has the fixing sections 9*c*2, which are formed at a front end portion located in a position close to the insertion port 3*e* in the connection chamber 3*c* and fixed to the movable housing 3. The contact receiving section 9*c* can therefore be reliably so fixed as not to protrude into the connection chamber 3*c*, whereby the pin terminal T comes into contact with the front end portion of the contact receiving section 9*c* to be avoided buckling of the contact receiving section 9*c*.

The first contact piece section 9*b* and the second contact piece section 9*d* are formed as spring pieces displaceable independently of each other. The first contact piece section 9*b* and the second contact piece section 9*d* can therefore each come into contact with the pin terminal T independently of the other without affecting the contact pressure, the contact position, and other contact states of the other with respect to the pin terminal T.

The second contact piece section 9*d* is configured as a part linked to the contact receiving section 9*c*. More specifically, the base end of the second elastic arm 9*d*1 is so formed as to be linked to the contact receiving section 9*c*, whereby an increase in the size of the contact section 9 is suppressed. That is, in the case of forming the second contact piece section 9*d* in such a way that it extends from the fixed base section 9*a* in parallel to the first contact piece section 9*b* in the same direction in which the first contact piece section 9*b* extends, the first contact section 9*b*2 and the second contact section 9*d*2 need to be positionally shifted from each other in the insertion direction of the pin terminals T (direction Z) to avoid interference between the first contact section 9*b*2 and the second contact section 9*d*2. In this case, the size of the contact section 9 undesirably increases in the insertion direction (direction Z). On the other hand, configuring the second contact piece section 9*d* as a part linked to the contact receiving section 9*c* allows reduction in the size of the second contact piece section 9*d* because the direction in which the first elastic arm 9*b*1 extends and direction in which the second elastic arm 9*d*1 extends does not coincide with each other but intersect each other, whereby the size of the contact section 9, which has a terminal structure having the two contact piece sections 9*b* and 9*d*, can be reduced.

The second elastic arm 9*d*1 is so formed as to link the plate edges 9*a*1 and 9*c*3 to each other, which are located on the same side with the linkage section 9*f*, which links the fixed base section 9*a* to the contact receiving section 9*c*, whereby the second elastic arm 9*d*1 and the linkage section 9*f* are disposed side by side on one side of the contact section 9. An increase in the size of the contact section 9 in the width direction (direction X) can therefore be suppressed, whereby the size of the multi-contact connector 1 can be reduced.

The first contact section 9*b*2 protrudes beyond the contact protrusion 9*d*3 of the second contact section 9*d*2 toward the contact receiving section 9*c*. Therefore, when the pin terminal T is inserted, the pressing contact provided by the first contact section 9*b*2 presses the pin terminal T against the contact surface section 9*c*1 to achieve an appropriate insertion attitude of the pin terminal T along the flat surface of the contact surface section 9*c*1. In this state, the contact protrusion 9*d*3 can achieve pressing contact with the pin terminal T, whereby contact that causes buckling of the second contact section 9*d*2 can be avoided.

The first contact section 9*b*2 is formed in a convexly bent shape. The space above an inclining piece of the first contact section 9*b*2 or the inclining piece on the far side in the insertion direction therefore forms a dead space. In the multi-contact connector 1, however, since the second contact section 9*d*2 is disposed in the space, the second contact section 9*d*2 does not protrude beyond the space between the first contact section 9*b*2 and the linkage section 9*f* and out of the contact section 9, whereby the size of the contact section 9 can be reduced, and the multi-contact connector 1 can also be formed as to be compact.

Figure 11:
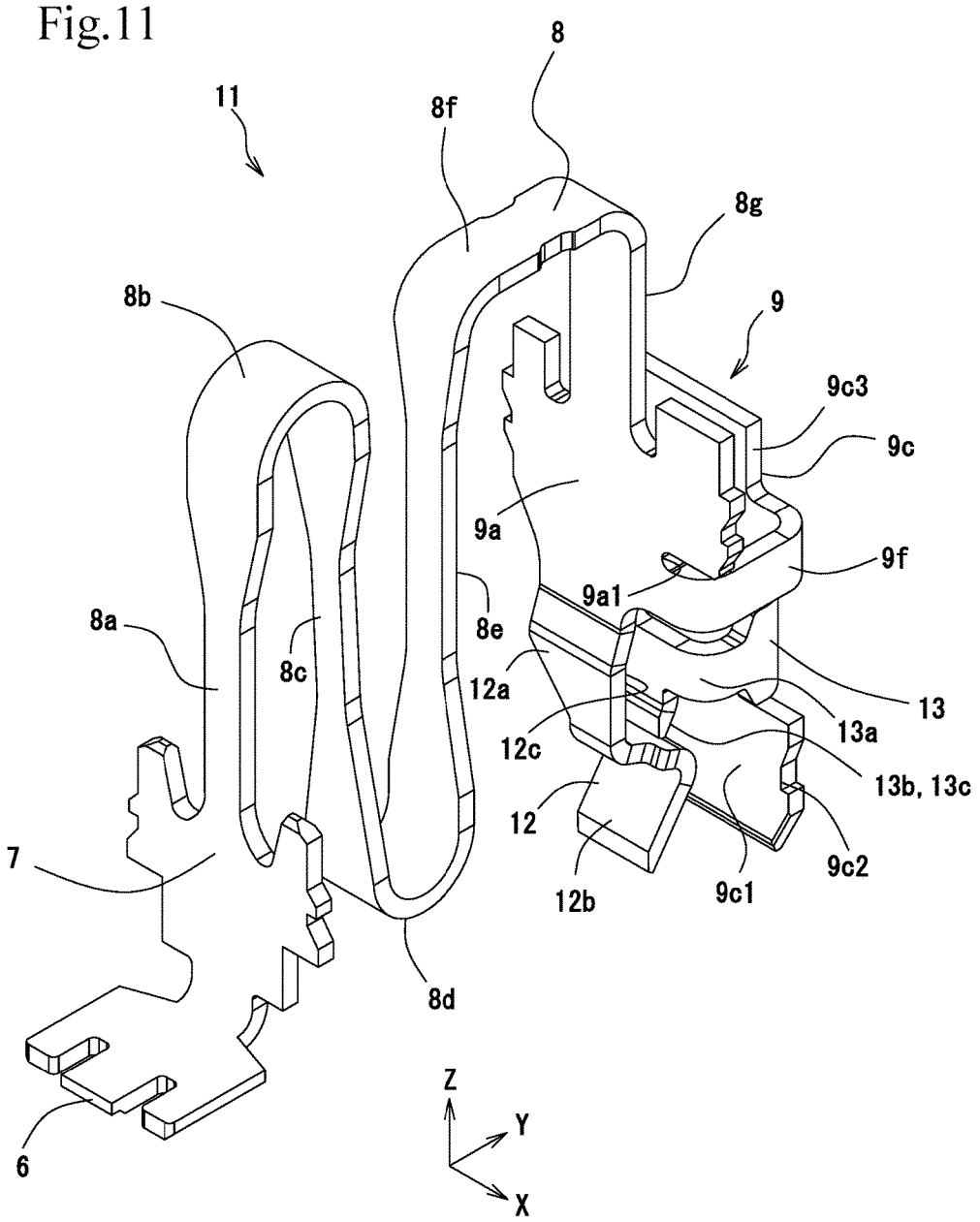
FIG. 11 is an exterior perspective view including the front surface, the right side surface, and the plan surface of a terminal provided in a multi-contact connector according to a second embodiment.
Figure 12:
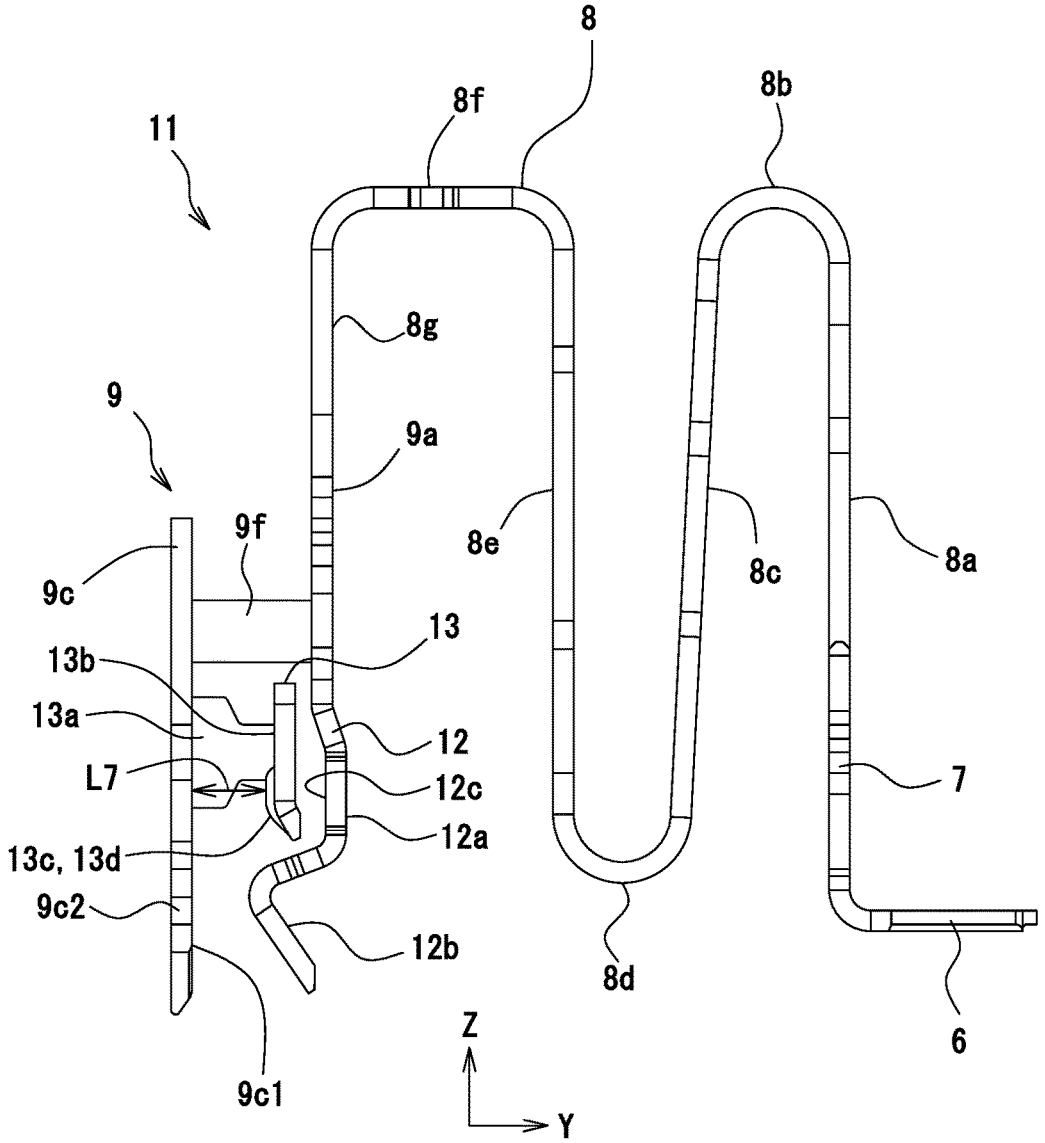
FIG. 12 is a left side view of the terminal shown in FIG. 11.
Figure 13:
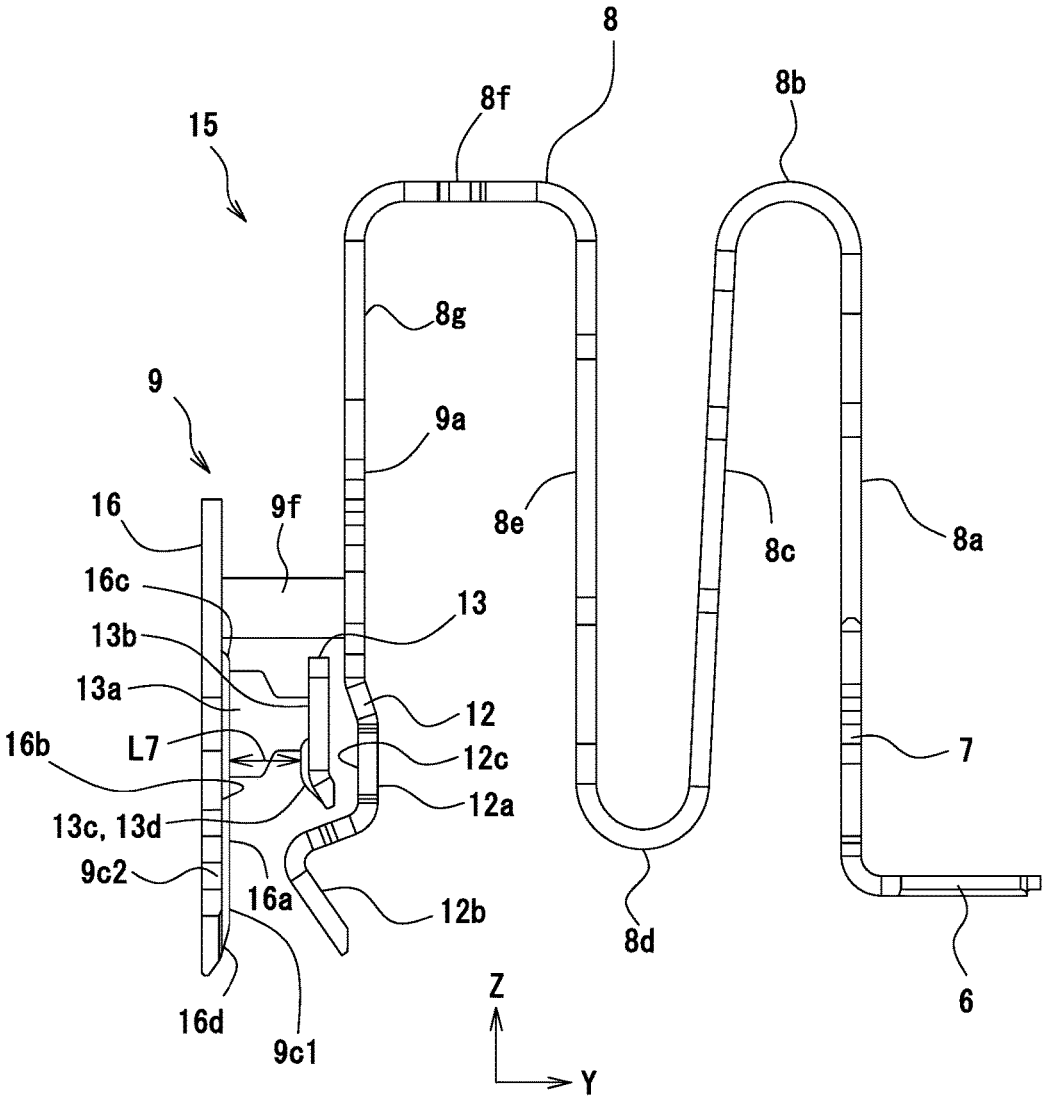
FIG. 13 is a left side view of a terminal provided in a multi-contact connector according to a third embodiment.

Second Embodiment [FIGS. 11 to 12]

A multi-contact connector according to a second embodiment differs from the multi-contact connector 1 according to the first embodiment in terms of a first contact piece section 12 and a second contact piece section 13 of each of terminals 11, and the two multi-contacts are the same in terms of the other configurations and advantageous effects based thereon. Only the differences will therefore be described, and the points common to those in the first embodiment will not be redundantly described.

The first contact piece section 12 has a first elastic arm 12*a* and a first contact section 12*b*, which is the same as the first contact section 9*b*2 in the first embodiment. Out of the two components that form the first contact piece section 12, the first elastic arm 12*a* has a clearance recess section 12*c*, which is formed in the middle of the first elastic arm 12*a* and bends so as to protrude toward the side opposite the second contact piece section 13.

The second contact piece section 13 in the present embodiment has a second elastic arm 13*a* and a second contact section 13*b*. Out of the two components that form the second contact piece section 13, the second contact section 13*b* has a guiding inclining surface 13*c*, which guides the insertion of the pin terminal T, at a front end portion of the second contact section 13*b*. The second contact section 13*b* further has a contact protrusion 13*d* which seamlessly protrudes in the form of a bead from the guiding inclining surface 13*c*, and the contact protrusion 13*d* achieves pressing contact with the pin terminal T.

The multi-contact connector including the thus configured terminals 11 in the second embodiment can provide the following advantageous effects in addition to the advantageous effects provided by the multi-contact connector 1 according to the first embodiment.

First, the first elastic arm 12*a* has the clearance recess section 12*c*. Therefore, when the second contact section 13*b* achieves pressing contact with the pin terminal T and is therefore displaced toward the first elastic arm 12*a*, the second contact section 13*b* merely enters the clearance recess section 12*c* but does not come into contact with the first elastic arm 12*a*. The second contact section 13*b* can therefore achieve electrically continuous contact with the pin terminal T at predetermined contact pressure. In a case where no clearance recess section 12*c* is formed, the second contact section 13*b* needs to be further separate from the first contact piece section 12 so that the displaced second contact section 13*b* does not come into contact with the first elastic arm 12*a*. Specifically, the linkage section 9*f* shown in FIG. 12 needs to be further extended leftward in FIG. 12. In this case, the size of the terminals 11 and the size of the multi-contact connector that includes the terminals 11 undesirably increase in the frontward/rearward direction Y. However, since the clearance recess section 12*c* can avoid the contact between the second contact section 13*b* and the first elastic arm 12*a*, the first elastic arm 12*a* and the second contact section 13*b* can be so disposed as to approach each other, whereby the terminals 11 and the multi-contact connector can be so formed as to be compact.

The guiding inclining surface 13*c*, which guides the insertion of the pin terminal T, is formed at the front end portion of the second contact section 13*b*. Therefore, even when the pin terminal T is obliquely inserted and is therefore likely to go through the space between the front end of the second contact section 13*b* and the first contact section 12*b*, the pin terminal T abuts against the guiding inclining surface 13*c* and is therefore not allowed to enter the space.

Third Embodiment [FIGS. 13 to 15A and 15B]

A multi-contact connector according to a third embodiment differs from the multi-contact according to the second embodiment in terms of a contact receiving section 16 of each of terminals 15, and the two multi-contact connectors are the same in terms of the other configurations and advantageous effects based thereon. Only the differences will therefore be described.

A contact surface section 16*a*, which protrudes toward the first contact section 12*b* and the second contact section 13*b*, is formed in a central portion of the contact receiving section 16 of each of the terminals 15. The contact surface section 16*a* is so formed as to be wider than the pin terminal T but narrower than the contact receiving section 16 in the width direction (direction X), and the contact surface section 16*a* is further so formed as to extend in the length direction (direction Z) from the front end of the contact receiving section 16 to a position between the second elastic arm 13*a* and the linkage section 9*f*. When the contact surface section 16*a* is taken as a "protruding portion" of the contact receiving section 16, the area around the contact surface section 16*a* is a flat general surface section 16*b*, which forms a "non-protruding portion" of the contact receiving section 16. The contact surface section 16*a* is formed of a bead-shaped "protrusion," and an opposite surface of the contact surface section 16*a* that comes into contact with the pin terminal T is a recess. The insertion gap L7, into which the pin terminal T is inserted, between the contact surface section 16*a* and the contact protrusion 13*d* of the second contact section 13*b* is set to be equal to the insertion gap L7, into which the pin terminal T is inserted, between the contact surface section 9*c*1 and the second contact section 13*b* in the second embodiment, so that the gap between the contact receiving section and the second contact piece section is greater in the third embodiment than in the second embodiment in the frontward/rearward direction (direction Y) by the length over which the contact surface section 16*a* protrudes.

Figure 14:
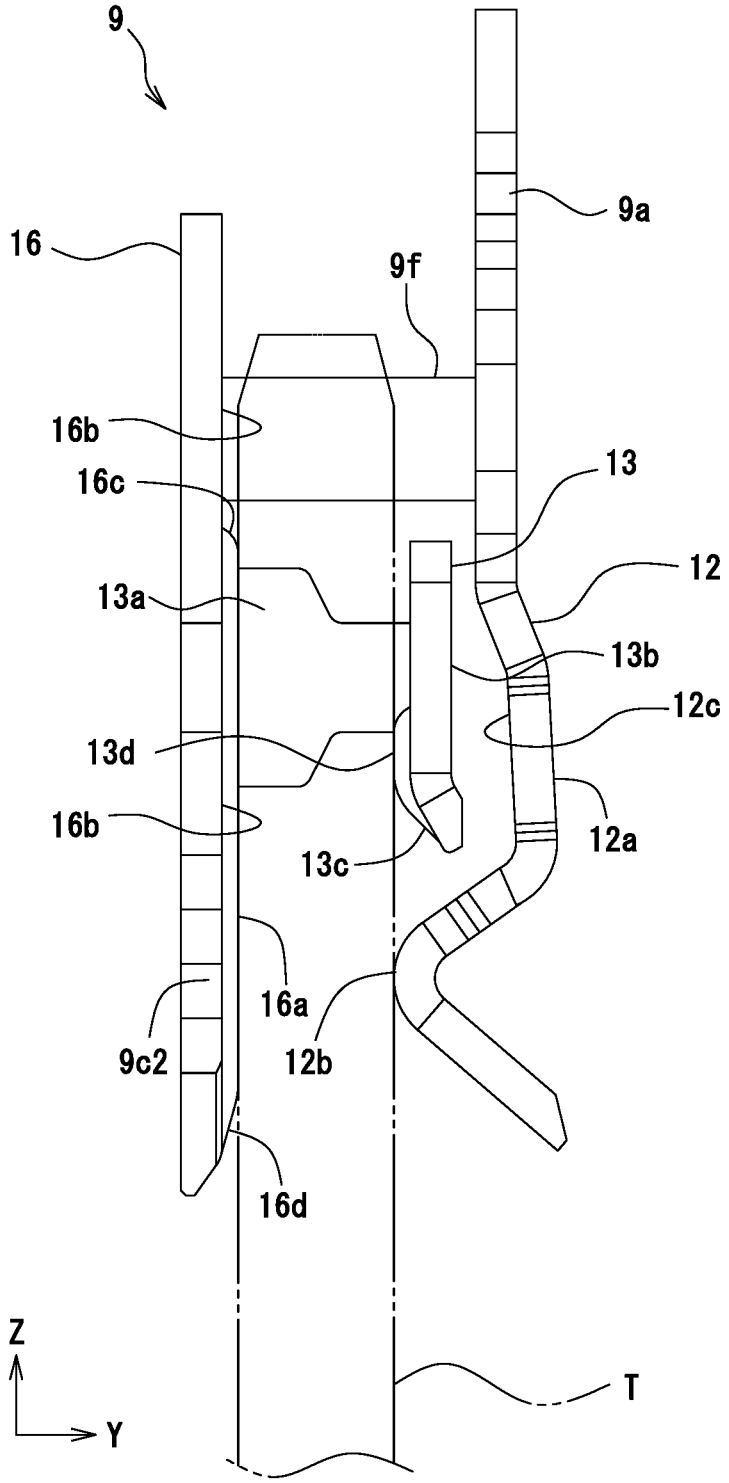
FIG. 14 is an enlarged view of a contact section of the terminal shown in FIG. 13.

FIG. 14 shows the state in which the pin terminal T is in contact with the contact surface section 16*a*. Steps 16*c* and 16*d* are formed at one end and the other end of the contact surface section 16*a*, respectively, in the insertion direction of the pin terminals T. Therefore, in the fitting connection state in which the pin terminal T is fitted and connected to the contact section 9, the pin terminal T is not in contact with but separate from the general surface section 16*b*, which is lower than the contact surface section 16*a*, and the pin terminal T is in contact only with the contact surface section 16*a*.

Figure 15A:
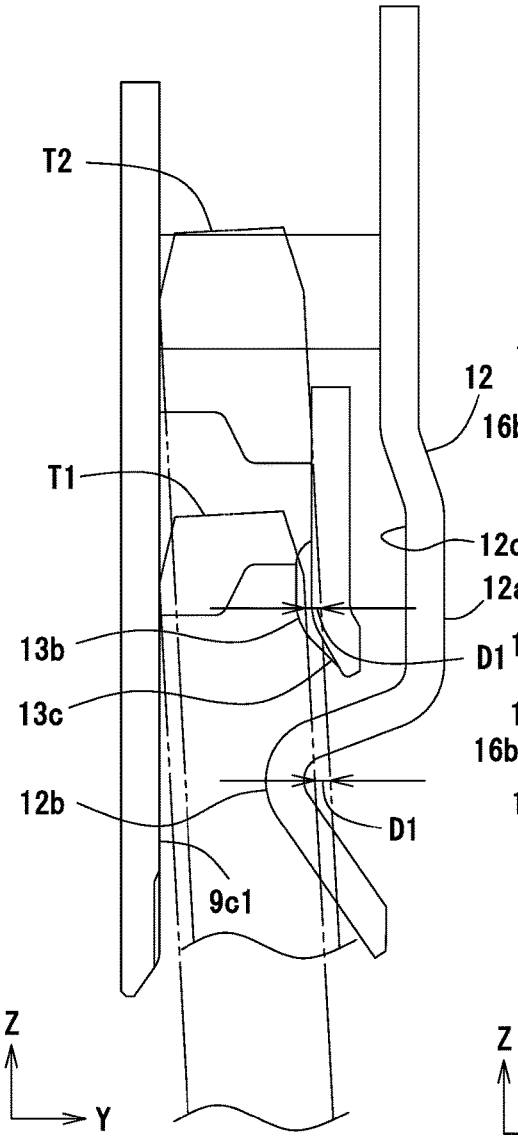
FIGS. 15A and 15B describe the action of the terminal shown in FIG. 13, FIG. 15A describing the action of the terminal in the second embodiment described with reference to FIG. 11, and FIG. 15B describing the action of the terminal in the third embodiment described with reference to FIG. 13.
Figure 15B:
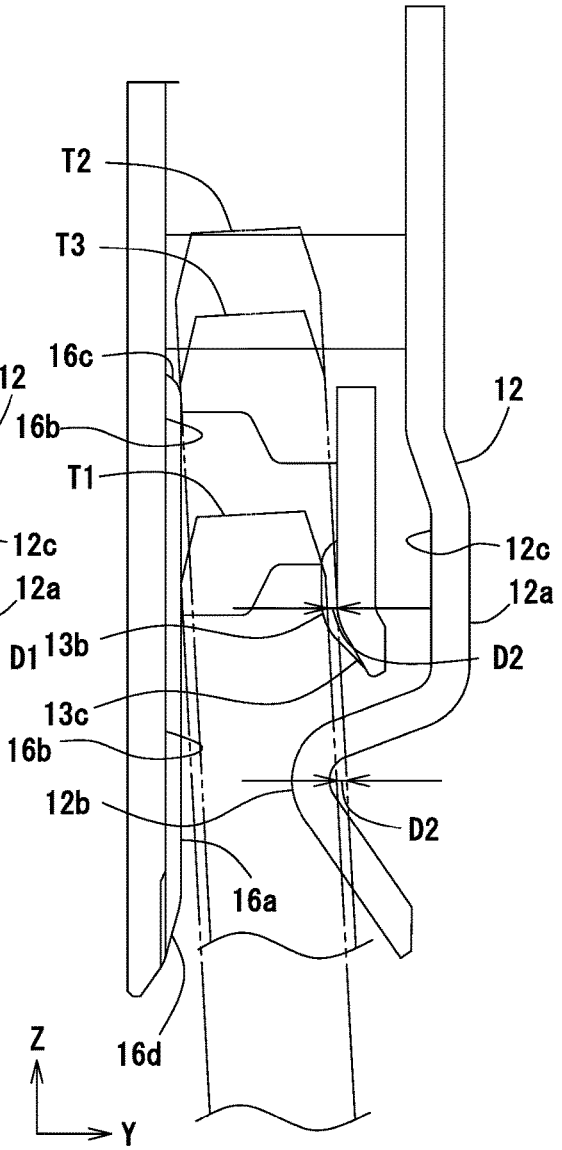

The thus configured contact surface section 16*a* provides the following advantage over the second embodiment: In the second embodiment, the contact surface section 9*c*1 is a flat surface, and when the insertion length of the pin terminal T varies and the pin terminal T is obliquely inserted, the amount of displacement of the first contact section 12*b* and the amount of displacement of the second contact section 13*b* differs from each other by a difference D1, as shown in FIG. 15A. That is, the amounts of displacement of the first contact section 12*b* and the second contact section 13*b* produced by a pin terminal T1, which is inserted by a smaller length, are smaller than the amounts of displacement produced by a pin terminal T2, which is inserted by a greater length, and the greater the insertion length is, the greater the difference D1 in the amount of displacement is. The difference D1 in the amount of displacement is reflected in the difference in the contact pressure acting on the pin terminal T, and the greater the difference D1 in the amount of displacement is, the higher the difference in the contact pressure is. Therefore, in the second embodiment, the contact pressure at each of the first contact section 12*b* and the second contact section 13*b* undesirably depends on the insertion length of the pin terminal T, so that the contact pressure cannot be controlled by the terminal 15 itself. Therefore, in a case where pressing contact provided at specific contact pressure needs to be performed on the pin terminal T, fitting connection based on a precise insertion length of the pin terminal T is required.

In contrast, in the case where the contact surface section 16*a*, which protrudes from the general surface section 16*b*, is provided, no management of the fitting connection achieved by a precise insertion length of the pin terminal T is required. That is, the pin terminal T1 shown in FIG. 15B indicates an insertion position that minimizes the insertion length (effective fitting length) that allows electrically continuous contact with the first contact section 12*b* and the second contact section 13*b*. The pin terminal T2 indicates an insertion position that provides an insertion length that allows electrically continuous contact with the first contact section 12*b* and the second contact section 13*b* and causes the front end of the pin terminal T2 to be located beyond the upper end of the contact surface section 16*a*, and this insertion position is a normal contact position. Even when the pin terminal T1 and the pin terminal T2 differ from each other in terms of the insertion length, a difference D2 in the amount of displacement between the first contact section 12*b* and the second contact section 13*b* can be reduced as compared with the case shown in FIG. 15A. In particular, a pin terminal T3 indicates an insertion position where the front end of the pin terminal T3 comes into contact with the contact surface section 16*a* in a position before the step 16*c* at the upper end of the contact surface section 16*a*, and the pin terminal T3 and the pin terminal T2, which is so inserted as to be located beyond the step 16*c*, produce the same amounts of displacement of the first contact section 12*b* and the second contact section 13*b*, and the contact pressure is therefore the same. The contact pressure produced by the first contact section 12*b* and the second contact section 13*b* can therefore be controlled by the terminal 15 itself irrespective of the insertion length of the pin terminal T.

Figure 16:
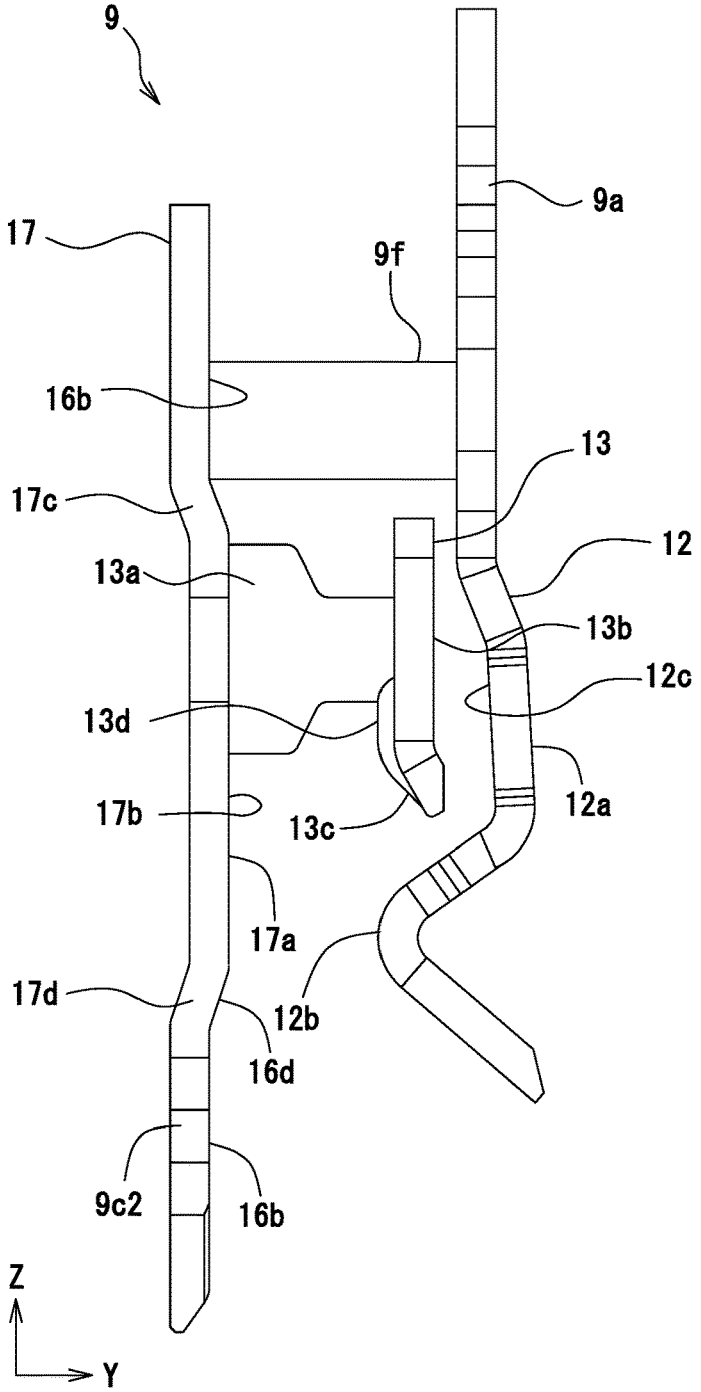
FIG. 16 is an enlarged view of a contact section according to a variation of the terminal shown in FIG. 13.

Variation of Third Embodiment [FIG. 16]

The contact receiving section 16 in the third embodiment described above can be replaced with a contact receiving section 17 in a variation shown in FIG. 16. The contact receiving section 17 has a contact surface section 17*a*, which protrudes toward the first contact section 12*b* and the second contact section 13*b*. The contact surface section 17*a* is formed of a protruding surface section 17*b*, a first bent section 17*c*, and a second bent section 17*d*. The contact surface section 17*a*, which provides the same advantageous effect provided by the contact surface section 16*a* in the third embodiment, can be provided by bending an electrically conductive plate that is the raw material of the contact receiving section 17. That is, when the pin terminal T is inserted to a point beyond the first bent section 17*c*, the contact pressure produced by the first contact section 12*b* and the second contact section 13*b* can be controlled to be a fixed value by the terminal 15 itself irrespective of the insertion length of the pin terminal T.

To employ the contact surface section 17*a*, the first bent section 17*c* needs to be formed in a position between the second elastic arm 13*a* and the linkage section 9*f*, and the second bent section 17*d* needs to be formed in a position closer to the front end of the contact receiving section 17 than the first contact section 12*b*. Further, since the fixing sections 9*c*2 need to be provided in a position closer to the front end of the contact receiving section 17 than the second bent section 17*d*, the contact receiving section 17 in the variation is undesirably longer than the contact receiving section 16 in the third embodiment. Conversely, the contact receiving section 16 having the bead-shaped contact surface section 16*a* can be so formed to be shorter than the contact receiving section 17 in the variation, in which the contact surface section 17*a* is caused to protrude by bending, and is therefore advantageous in that the size of the terminals 15 can be reduced and the size of the multi-contact connector that includes the terminals 15 can be reduced.

Other Variations

In the embodiments described above, the contact receiving sections 9*c*, 16, and 17 are so formed by way of example as to extend from the portion linked to the linkage section 9*f* to the position facing both the first contact sections 9*b*2 and 12*b* and the second contact sections 9*d*2 and 13*b*. Instead, for example, the contact receiving sections 9*c*, 16, and 17 can be so formed as to extend from the portion linked to the linkage section 9*f* to the position facing only the second contact sections 9*d*2 and 13*b*. The contact receiving sections 9*c*, 16, and 17 can therefore be shortened, whereby the size of the terminals 4 and the size of the entire multi-contact connector 1 including the terminals 4 can be reduced in the height direction (direction Z). Still instead, the contact receiving sections 9*c*, 16, and 17, to further shorten them, can be configured to extend from the portion linked to the linkage section 9*f* to a portion linked to the second elastic arms 9*d*1 and 13*a* but face none of the first contact sections 9*b*2, 12*b* and the second contact sections 9*d*2, 13*b*. The sizes of the terminals 4 and the multi-contact connector 1 can therefore be further reduced in the direction Z.

What is claimed is:

1. A multi-contact connector comprising: terminals each including a first contact piece section having a first contact section that achieves pressing contact with a connection target object in a first direction and a first elastic arm that extends in a direction that intersects the first direction and displaceably supports the first contact section, and a second contact piece section having a second contact section that achieves pressing contact with the connection target object in the first direction and a second elastic arm that displaceably supports the second contact section, wherein the second elastic arm extends in the first direction toward the first elastic arm and has a front end portion facing the first elastic arm and is formed as a spring piece linked to the second contact section.

2. The multi-contact connector according to claim 1, wherein the second contact section faces the first elastic arm.

3. The multi-contact connector according to claim 1, wherein the terminals each have a support piece to which the second elastic arm is linked.

4. The multi-contact connector according to claim 3, wherein the support piece is so formed as to extend from a portion linked to the second elastic arm to a position facing the second contact section.

5. The multi-contact connector according to claim 3, wherein the support piece is so formed as to extend from a portion linked to the second elastic arm to a position facing the first contact section and the second contact section.

6. The multi-contact connector according to claim 3, wherein the second elastic arm is so shaped as to link opposing plate edges of the second contact section and the support piece.

7. The multi-contact connector according to claim 3, wherein the terminals each have a fixed base section that supports the first contact piece section in a form of a cantilever and a linkage section that extends in the first direction and links the fixed base section to the support piece.

8. The multi-contact connector according to claim 1, wherein the first contact piece section has a clearance recess section that avoids contact with the second contact section displaced toward the first contact piece section when the second contact section receives the pressing contact achieved by the connection target object.

* * * * *